United States Patent [19]

Jones

[11] Patent Number: 4,727,225

[45] Date of Patent: Feb. 23, 1988

[54] ELECTRICAL SWITCH FOR ACTUATING A PLURALITY OF CIRCUITS

[75] Inventor: John C. Jones, Chicago, Ill.

[73] Assignee: Illinois Tool Works Inc., Chicago, Ill.

[21] Appl. No.: 883,999

[22] Filed: Jul. 10, 1986

[51] Int. Cl.[4] ..... H01H 9/00

[52] U.S. Cl. ..... 200/5 A; 200/153 LB; 200/159 B

[58] Field of Search ..... 200/5 A, 6 A, 153 LB, 200/159 B; 361/416; 340/365 R

[56] References Cited

U.S. PATENT DOCUMENTS

| | | | |
|---|---|---|---|
| 3,551,616 | 12/1970 | Juliusburger et al. | 200/159 B |
| 4,376,238 | 3/1983 | Martin | 200/1 B X |
| 4,559,419 | 12/1985 | Overman et al. | 200/5 R |

*Primary Examiner*—A. D. Pellinen
*Assistant Examiner*—Morris Ginsburg
*Attorney, Agent, or Firm*—D. J. Breh; T. W. Buckman

[57] ABSTRACT

An electrical switching apparatus is disclosed for making or breaking a plurality of electrical connections substantially simultaneously. The apparatus includes a planar substrate, a first set of electrical terminals arrayed on the substrate in a pattern providing mating pairs of terminals displaced by a distance, an actuator having a contact effecting surface and carrying thereon a plurality of moveable bridging contacts which are in substantial registration each with a respective mating pair of terminals. The actuator response to application of an actuating force toward the substrate to establish bridging contact by the bridging contact between each of the mating pairs of terminals substantially simultaneously. In the preferred embodiment a plurality of such switching apparati are actuated by a common actuating shaft.

8 Claims, 5 Drawing Figures

ELECTRICAL SWITCH FOR ACTUATING A PLURALITY OF CIRCUITS

BACKGROUND OF THE INVENTION

The present invention is directed to an electrical switching apparatus for making and breaking a plurality of electrical connections substantially simultaneously.

A typical application of such a device as is disclosed herein is employment as a switching apparatus to accommodate the switching functions of computer data circuits, each of which circuits typically is comprised of 24 data lines. However, the present invention could as well be utilized in any situation requiring the substantially simultaneous making or breaking of a plurality of electrical connections.

SUMMARY OF THE INVENTION

The invention is an electrical switching apparatus for making or breaking a plurality of electrical connections substantially simultaneously. The present invention is designed to provide a more reliable, cheaper to manufacture electrical switching apparatus than has heretofore been available for such multiple simultaneous switching applications.

A typical method by which multiple simultaneous switching of electrical circuits, such as computer data circuits, has been through the stacking of rotary switch modules to provide the necessary 24-line capacity. Such stacking of rotary switch elements is a straightforward approach to the solution of selection of interconnection of 24-line sets of connections. However, the cost of manufacturing such rotary switch devices is prohibitively expansive in comparison with the cost of manufacture of a device according to the present invention. The numbers of rotary switch modules and the labor involved in effecting selected connections among the rotary switch modules to accomplish the electrical connectivity required for the desired switching function are significantly more expensive than the simplified construction and connections associated with the present invention.

It is therefore an object of this invention to provide an electrical switching apparatus for making and breaking a plurality of electircal connections substantially simultaneously which is simple in construction and provides reliability and durability in its operation.

A further object of this invention is to provide an electrical switching apparatus for making and breaking a plurality of electrical connections substantially simultaneously which is inexpensive to construct.

Further objects and features of the present invention will be apparent from the following specification and claims when considered in connection with the accompanying drawings illustrating the invention.

DETAILED DESCRIPTION OF THE INVENTION

Figure 2:
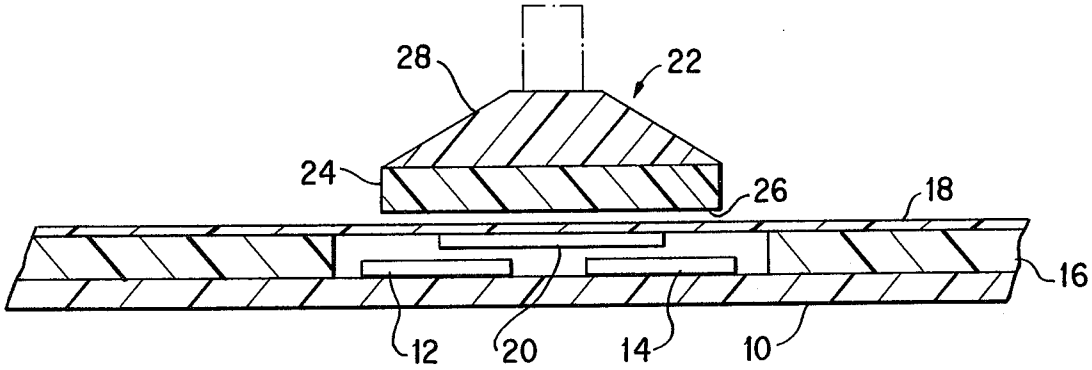
FIG. 2 is a side view of a schematic section drawing of a single switching element of a first embodiment of the present invention.

A first embodiment of an electrical switching apparatus for making and breaking a plurality of electrical connections substantially simultaneously as shown in FIG. 2. In FIG. 2 a substantially rigid substrate 10 carries thereon a set of fixed electrical terminals 12 and 14. A non-conductive spacer 16 surrounds the fixed electrical terminals 12 and 14 and suspends above the electrical terminals 12 and 14 a flexible membrane 18. Carried on the flexible membrane 18 is a moveable bridging contact 20. The moveable bridging contact 20 is in spaced facing relationship with respect to the fixed electrical terminals 12 and 14. Situated above the flexible membrane 18 is an actuator 22. The actuator 22 is comprised of a contact pad 24 which presents a contact effecting surface 26 in facing relationship with the flexible membrane 18 and substantially in register with the moveable bridging contact 20.

The actuator 22 is further comprised of a contact pad carrier 28 to which the contact pad 24 is affixed.

For the purposes of facilitating understanding of the invention, like elements will be assigned like reference numerals in the various views and various embodiments illustrated herein.

Figure 1:
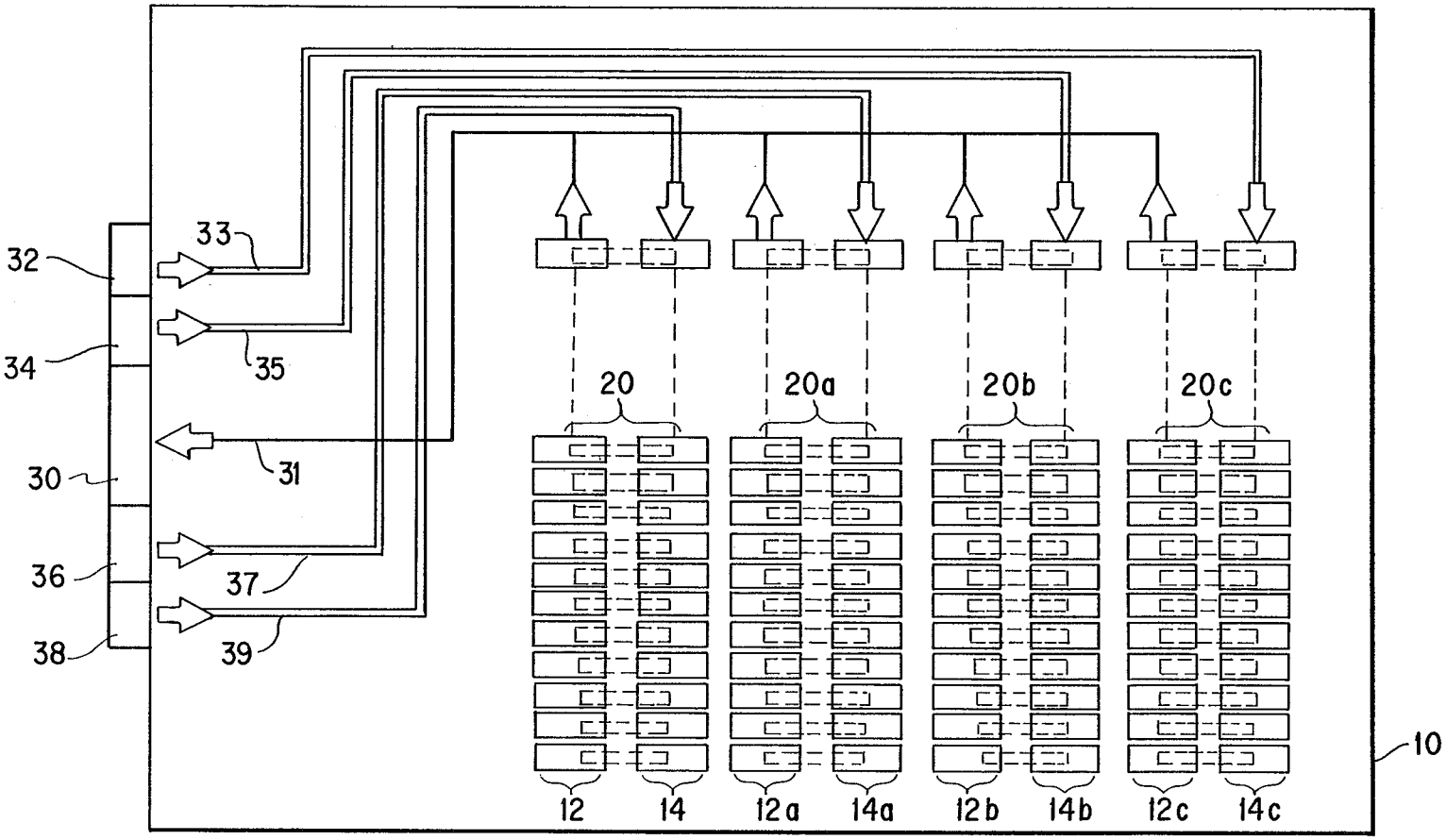
FIG. 1 is a top schematic plan view of the fixed contact array of the present invention.

Accordingly, in FIG. 1 a rigid substrate 10 carries thereon an array of fixed electrical terminals 12 and 14. Additional arrays of fixed electrical terminals, such as **12*a*, 14*a*; 12*b*, 14*b*; and 12*c*, 14*c* would preferably be carried on the same rigid substrate 10. The carrying of multiple arrays of fixed electrical terminals 12, 14 on a single rigid substrate 10** facilitates the actuation of a plurality of actuators by a single actuating means, as will be hereinafter discussed in greater detail.

Continuing to refer to FIG. 1, bridging contacts **20, 20*a*, 20*b* and 20*c* are shown in phantom as being substantially in register with their respective fixed electrical terminal pairs 12, 14; 12*a*, 14*a*; 12*b*, 14*b*; and 12*c*, 14*c*. The numbers of pairs of fixed electrical terminals 12, 14 in a given array may vary according to the particular application for which the electrical switching apparatus is designed. For example, in situations involving computer data circuits, the numbers of pairs of fixed electrical terminals 12, 14 in the given array commonly equals 24** such pairs.

It is emphasized that FIG. 1 is a schematic representation of the fixed electrical terminal array of the present invention. In an actual plan view of the fixed electrical terminal array of the present invention, each of the sets of fixed electrical terminals 12, for example, would be independently connected to its own line and a bundle of lines (24 lines in each bundle) would be connected to an input or output pin. FIG. 1 schematically represents this relationship by showing a single connection representing 24 connections. Accordingly, 24-line connector 30 would, for example, be connected to a host computer (not shown) and commonly connected to each of the fixed electrical terminal arrays **12, 12*a*, 12*b*, and 12*c* by 24-line cable 31. Similarly, 24-line connector 32 could be an input from a printing device (not shown) and connected via 24-line cable 33 to fixed electrical terminal array 14*c*. By way of further example, 24-line connector 34** could be receiving an input from or delivering an output to an off-line storage device (not shown) and be connected by 24-line cable 35 to fixed electrical terminal 14*b*. 24-line connectors 36 and 38 could be operably connected to other peripheral computer devices (not shown) and respectively connected by 24-line cable 37 to fixed electrical contact array 14*a* and by 24-line cable 39 to fixed electrical contact array 14.

Figure 3:
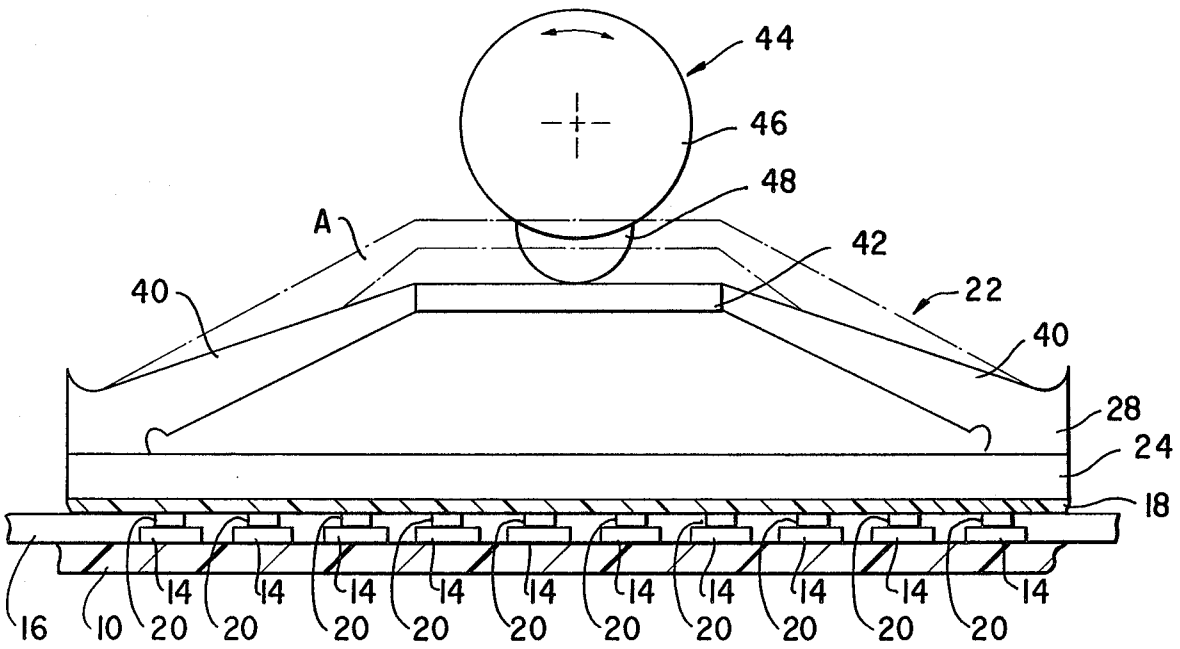
FIG. 3 is a schematic front view of the single switching element illustrated in FIG. 2.

The front view of the electrical switching apparatus of the present invention shown in FIG. 3, when considered in connection with FIGS. 1 and 2, serves to complete the explanation and illustration of the first embodiment of the present invention.

In FIG. 3, a rigid substrate 10 carries thereon a plurality of fixed electrical terminals 14 and a plurality of fixed electrical terminals 12 (not visible in FIG. 3 since they are masked by fixed electrical terminals 14). The spacer 16 maintains the flexible membrane 18 in spaced relationship from the rigid substrate 10 and its associated fixed electrical terminals 12 and 14. The flexible membrane 18 carries thereon a plurality of moveable bridging contacts 20; the plurality of moveable bridging contacts 20 is equal in number to the number of fixed electrical terminal pairs 12, 14 and is maintained in substantial registration and in spaced relationship with respect to respective fixed electrical terminal pairs 12, 14.

The contact pad 24 is preferably slightly longer than the expanse of the full array of fixed electrical terminal pairs 12, 14 in order to ensure substantially equal contact pressure is applied upon each of the fixed electrical terminal pairs 12, 14 by its respective moveable bridging contacts 20 through the contact pad 24, as hereinafter described in greater detail.

The contact pad carrier 28 is more clearly seen in FIG. 3 to comprise a pair of resilient arms 40 depending from the contact pad 24 and connected by a bearing arm 42. Thus an actuating means 44, such as a shaft 46 with an affixed cam 48 would serve to displace the contact pad carrier 28 from an initial position A by bringing the cam 48 to bear upon the bearing arm 42, forcing the bearing arm 42 downward from initial position A and displacing it to a position as shown in FIG. 3 by flexing the pair of resilient arms 40.

In operation, the contact pad carrier 28 is displaced by the cam 48 in response to rotation of the shaft 46. The contact pad 24, carried upon the contact pad carrier 28, is thereby displaced against the flexible membrane 18 and forces the movable bridging contacts 20 into contact with the array of fixed electrical terminal pairs 12, 14. The flexing of resilient arms 40 provides an overtravel action for the actuator 22 after contact of the moveable bridging contacts 20 with the respective fixed electrical terminal pairs 12, 14.

Figure 4:
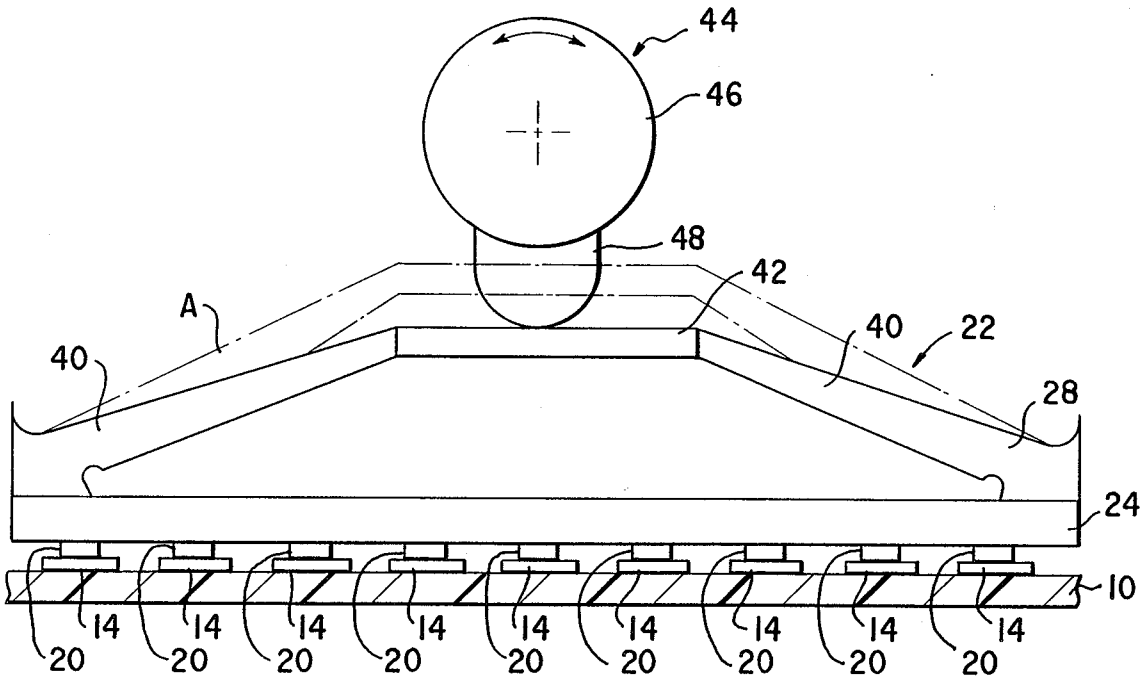
FIG. 4 is a schematic front view of a single switching element of the preferred embodiment of the present invention.

FIG. 4 illustrates an alternate embodiment of the electrical switching apparatus of the present invention which eliminates the upper flexible membrane of the first embodiment discussed hereinabove and affixes the moveable bridging contacts directly to the contact pad. Thus, in FIG. 4, a rigid substrate 10 carries thereon a plurality of fixed electrical terminals 14 and fixed electrical terminals 12 (not visible in FIG. 4 since they are masked by fixed electrical terminals 14). Suspended above the array of fixed electrical terminal pairs 12, 14 is an actuator 22. The actuator 22 is comprised of a contact pad 24 on which are carried a plurality of moveable bridging contacts 20. The moveable bridging contacts 20 are substantially each in register with their respective fixed electrical terminal pairs 12, 14. The contact pad 24 is affixed to a contact pad carrier 28 which is comprised of a pair of resilient arms 40 connected by a bearing arm 42. An actuating means 44, preferably comprising a shaft 46 and an affixed cam 48 may be rotated to bring the cam 48 in contact with the bearing arm 42. In response to such camming, the actuator 22 is displaced from initial position A to bring the moveable bridging contacts 20 into electrical contact, each with its respective fixed electrical terminal pair 12, 14. The flexing of resilient arms 40 provides an overtravel for the actuator 22 after contact of the moveable bridging contacts 20 with the respective fixed electrical terminal pairs 12, 14.

Figure 5:
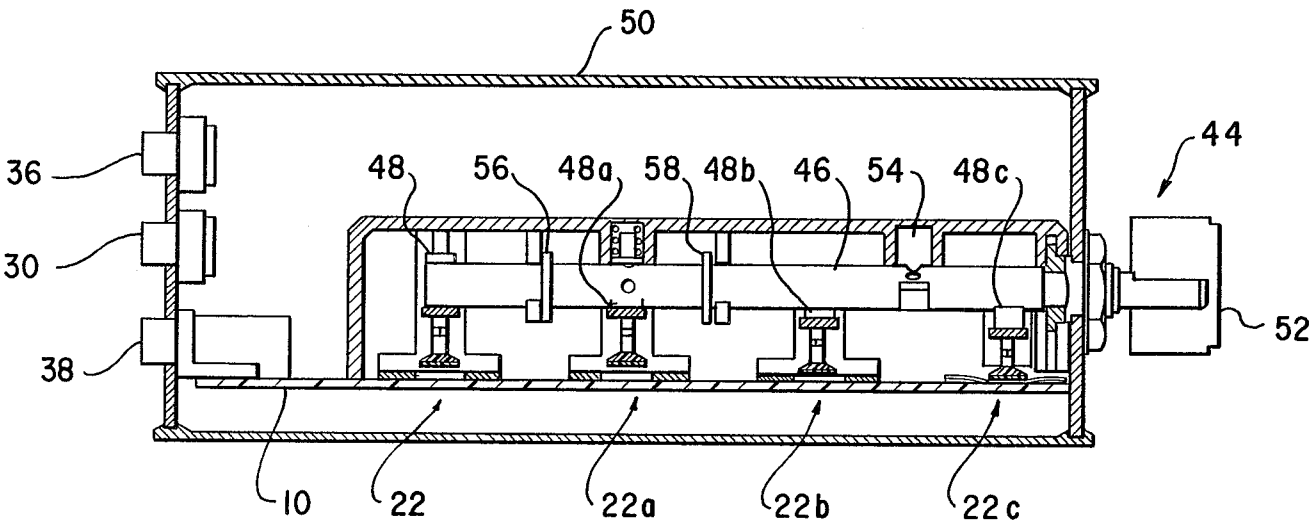
FIG. 5 is a side view of a schematic section drawing of the present invention illustrating the employment of a common actuator for multiple switching elements.

FIG. 5 shows a preferred embodiment of the complete electrical switching apparatus according to the present invention. For clarity of illustration, all electrical connections from the 24-line connectors, such as 36, 38 and 30 have been omitted. In FIG. 5, a housing 50 suspends therein a rigid substrate 10 on which is carried a plurality of fixed electrical terminal pairs 12, 14 (FIG. 1). A plurality of actuators 22, 22*a*, 22*b*, and 22*c* are suspended above the rigid substrate 10. The actuators 22, 22*a*, 22*b*, and 22*c* may be either of the embodiment depicted in FIG. 3 or in FIG. 4. By way of illustration, the actuators 22, 22*a*, 22*b*, and 22*c* illustrated in FIG. 5 are of the type discussed in connection with FIG. 3.

A feature of the present invention sought to be illustrated by FIG. 5 is that a common actuating means 44 comprising a shaft 46 and a plurality of cams 48, 48*a*, 48*b*, and 48*c* is used for actuation of all of the actuators 22, 22*a*, 22*b*, and 22*c*. The cams 48, 48*a*, 48*b*, and 48*c* are affixed at varying radii of the shaft 46 in order that rotation of a common knob 52 or similar actuating means to rotate the shaft 46 will, depending upon the rotational orientation of the shaft 46, bring different cams 48, 48*a*, 48*b*, and 48*c* to bear upon the various actuators 22, 22*a*, 22*b*, and 22*c*. Thus, the rotational displacement of the knob 52 and its consequent variance of rotational orientation of the shaft 46 will selectively actuate various of the actuators 22, 22*a*, 22*b*, and 22*c* through their respective cams 48, 48*a*, 48*b*, and 48*c*. Of course, the cams could be arranged in order to simultaneously actuate two or more of the actuators; therein lies one of the versatile features of the present invention.

By way of further explanation, the shaft 46 may be provided with a detent mechanism 54 of a commonly known type, such as a ball and ridge arrangement, or the like. The shaft 46 is retained in its axial orientation by retainers 56 and 58.

It is to be understood that, while the detailed drawings and specific examples given describe preferred embodiments of the invention, they are for the purpose of illustration only, that the apparatus of the invention is not limited to the precise details and conditions disclosed and that various changes may be made therein without departing from the spirit of the invention which is defined by the following claims.

I claim:

1. A device making and breaking in a selected order a plurality of sets of electrical connections wherein each set of electrical connections includes a plurality of individual electrical connections which make and break substantially simultaneously, comprising a substantially rigid, substantially planar first substrate, a plurality of spaced apart terminal pairs arranged on a first side of said first substrate in a pattern, a flexible second substrate spanning said plurality of terminal pairs in spaced apart substantially parallel relationship therewith, a plurality of bridging contacts arranged on one side of said flexible substrate facing and being disposed for electrical contact with said terminal pairs, each said bridging contact and each of said plurality of terminal pairs defining one of said plurality of electrical connections, said pattern defining said sets of electrical connections, a plurality of actuator means each including an actuator member having a substantially planar contact effecting surface disposed adjacent to and substantially parallel to said second substrate on a second side of said second substrate opposite said one side thereof, the contact effecting surface disposed across each bridging contact of a respective one of said sets of electrical connections, each actuator member being responsive to an actuating force for movement in a direction substantially normal to said first and said second substrates, for contacting and moving said second substrate toward said first substrate, said bridging contacts of each set of electrical connections simultaneously making contact with said respective terminal pairs upon movement of the associated actuator member, said second substrate providing return bias to move said actuator member and said second substrate and simultaneously break contact between said bridging contacts and said terminal pairs upon removal of said actuating force, and actuation initiating means for operating said plurality of actuator means in said selected order.

2. The device making and breaking in a selected order a plurality of sets of electrical connections as claimed in claim 1 wherein said actuation initiating means comprises a shaft with a plurality of camming means affixed to said shaft, one of said plurality of camming means associated with each of said actuator members of said plurality of actuator members whereby movement of said shaft engages said plurality of camming means with its associated actuator member in said selected order.

3. The device making and breaking in a selected order a plurality of sets of electrical connections as claimed in claim 1 wherein each said actuator means includes at least one resilient arm connected to said actuator arm, each said resilient arm, operatively engaged by said actuation initiating means.

4. The device making and breaking in a selected order a plurality of sets of electrical connections as claimed in claim 3 wherein each said actuator means includes a pair of resilient arms connected to said actuator member said pair of resilient arms operatively engaged by said actuation initiating means, said pair of resilient arms being deflectable toward said actuator members upon contact of said bridging contacts with said terminal pairs.

5. A device making and breaking in a selected order a plurality of sets of electrical connections wherein each set of electrical connections includes a plurality of individual electrical connections which make and break substantially simultaneously, comprising a substantially rigid, substantially planar first substrate, a plurality of spaced apart terminal pairs arranged on a first side of said substrate in a pattern, a plurality of actuator means each including an actuator member having a substantially planar contact pad disposed parallel to and spaced from said terminal pairs each contact pad including a plurality of bridging contacts, each bridging contact disposed bridging the space between a respective one of said terminal pairs, said bridging contacts and said terminal pairs defining said plurality of sets of electrical connections each actuator member being responsive to an actuating force for movement in a direction substantially normal to said first substrate for moving said bridging contacts of each set of electrical connections into simultaneously making contact with each terminal pair of each said set, and actuation initiating means for operating each said actuator member.

6. The device making and breaking in a selected order a plurality of sets of electrical connections as claimed in claim 5 wherein said actuation initiating means comprises a shaft, a plurality of camming means affixed to said shaft, one of said plurality of camming means associated with each of said actuator members of said plurality of actuator members whereby movement of said shaft engages said plurality of camming means with its associated actuator member in said selected order.

7. The device making and breaking in a selected order a plurality of sets of electrical connections as claimed in claim 6 wherein each said actuator member further includes means providing for overtravel of each said actuator means after said briging contacts make contact with said terminal pairs.

8. The device making and breaking in a selected order a plurality of sets of electrical connections as claimed in claim 7 wherein said means providing for overtravel includes a pair of resilient arms connecting said actuator member to said actuation initiating means.

* * * * *